US005826441A

United States Patent [19]

Oh

[11] Patent Number: 5,826,441

[45] Date of Patent: Oct. 27, 1998

[54] REFRIGERATOR HAVING A DEVICE FOR GENERATING AIR CURTAINS

[75] Inventor: Min-Jung Oh, Incheon, Rep. of Korea

[73] Assignee: Daewoo Electronics Co., Ltd., Seoul, Rep. of Korea

[21] Appl. No.: 870,443

[22] Filed: Jun. 6, 1997

[51] Int. Cl.[6] ..... A47F 3/04

[52] U.S. Cl. ..... 62/256; 454/193

[58] Field of Search ..... 62/256, 255, 408; 454/188, 189, 191, 193

[56] References Cited

U.S. PATENT DOCUMENTS 2,775,187 12/1956 McClurkin ..... 62/256
4,058,989 11/1977 Horvay et al. ..... 62/256
4,379,391 4/1983 Rhee ..... 62/256
4,478,047 10/1984 Ibrahim ..... 62/256
4,962,649 10/1990 Battocletti ..... 62/256

*Primary Examiner*—William E. Tapolcai
*Attorney, Agent, or Firm*—Beveridge, DeGrandi, Weilacher & Young, LLP

[57] ABSTRACT

A refrigerator has a cool air duct having ports opened at areas adjacent to openings of a freezing compartment and a fresh food compartment respectively, a blowing fan for discharging air in the cool air duct so that air curtains for shutting off the openings of the freezing compartment and the fresh food compartment are generated, and a device for opening/closing the ports. When doors are opened, the opening/closing device opens the corresponding ports to the opened doors. Thus, the air curtains are formed both at the freezing compartment and the fresh food compartment.

6 Claims, 3 Drawing Sheets

REFRIGERATOR HAVING A DEVICE FOR GENERATING AIR CURTAINS

BACKGROUND OF THE INVENTION

1. Field of the Invention

The present invention relates to a refrigerator having a device for generating air curtains in which the air curtains are formed at the cooling compartments corresponding to open doors when the doors are opened.

2. Prior Art

FIG. 1 shows a conventional refrigerator, which shows a refrigerator having a device for generating an air curtain for shutting off the opening of a cooling compartment. The refrigerator has, as shown in FIG. 1, a cabinet 10 forming a freezing compartment 21 and a fresh food compartment 22 which are partitioned from each other by a wall 27, and a freezing compartment door 24 and a fresh food compartment door 25 which open/close the freezing compartment 21 and fresh food compartment 22 respectively.

A compressor 23 is installed in a lower rear part of the cabinet 10, and an evaporator 29 for generating cool air by evaporating refrigerant supplied from the compressor 23 is installed in the rear of the freezing compartment 21. Cooling fans 19 for blowing the cool air generated by the evaporator 29 are installed at the upper side of the evaporator 29. The cooling fans 19 consist of two fans to supply the freezing compartment 21 and the fresh food compartment 22 with the cool air respectively.

A device 20 for generating an air curtain is provided in the upper side of the fresh food compartment 22. The air curtain generating device 20 comprises a cool air duct 13 provided in the upper side of the fresh food compartment 22, and a blowing fan 11 for blowing the cool air from the evaporator 29 into the cool air duct 13. The cool air duct 13 is formed with a cool air discharge port 15 at one end thereof which is opened downward at the area adjacent to an opening of the fresh food compartment 22. The cool air blown into the cool air duct 13 is discharged downward, by which the air curtain for shutting off the opening of the fresh food compartment 22 is generated.

In the fresh food compartment 22, a sensor (not shown) for sensing the opening/closing of the fresh food compartment door 25 is provided, and the blowing fan 11 is controlled to operate only when the open state of the door 25 is sensed by the sensor. Thus, the air curtain is generated only when the door 25 is open so as to prevent leakage of the cool air through the opening of the fresh food compartment 22 at the open state of the door 25.

A plurality of cool air ports 16, 18 are formed at the rear walls of the freezing compartment 21 and the fresh food compartment 22. When the door 25 is closed, the cool air from the evaporator 29 is blown by the cooling fan 19 to be supplied into the freezing compartment 21 and the fresh food compartment 22, and accordingly the foodstuffs stored in the freezing compartment 21 and the fresh food compartment 22 are frozen and refrigerated respectively.

The cool air supplied in the fresh food compartment 25 through the cool air ports 18 circulates toward the evaporator 29 through the cool air duct 13. The cool air duct 13 functions as a discharge duct for generating the air curtain when the door 25 is open and as a circulation duct for circulating the cool when the door is close.

However, such a conventional refrigerator is burdened with the problem that the air curtain is generated only at the fresh food compartment 22 and therefore the leakage of cool air in the freezing compartment 21 cannot be prevented. In general, since the temperature in the freezing compartment 21 is still lower than that in the fresh food compartment 22, although the frequency of use of the freezing compartment 21 is small in comparison with that of the fresh food compartment 22, the amount of leakage of the cool air becomes great in a short time. Thus, it is required to generate the air curtain even when the freezing compartment door 25 is opened. In general refrigerator, however, due to the fact that the fresh food compartment 21 is more frequently used than the freezing compartment 22 and the fact that the amount of leakage of the cool air is greater in the fresh food compartment 22 since the fresh food compartment 22 is more capacious than the freezing compartment 21, the air curtain generating device 20 is adopted only to the fresh food compartment 21. Furthermore, there is the problem that the configuration of the refrigerator becomes complex and the cost in manufacture increases if the air curtain generating device 20 is adopted in both the freezing compartment 22 and the fresh food compartment 21.

SUMMARY OF THE INVENTION

The present invention has been proposed to overcome the above described problems in the prior art, and accordingly it is an object of the present invention to provide a refrigerator having an air curtain generating device which is possible to form air curtains at both the freezing compartment and the fresh food compartment so that the leakage of the cool air is effectively prevented, and the configuration thereof is simple.

To achieve the above object, the present invention provides a refrigerator having a cabinet forming cooling compartments which are partitioned from each other, and doors mounted on said cooling compartments for opening/closing openings of said cooling compartments respectively, said refrigerator comprising: a cool air duct having ports opened at areas adjacent to the openings of said cooling compartments respectively; a blowing fan for discharging air in said cool air duct, by which air curtains for shutting off the openings of said cooling compartments are generated; and a means for opening/closing the ports corresponding to open doors when said doors are opened.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
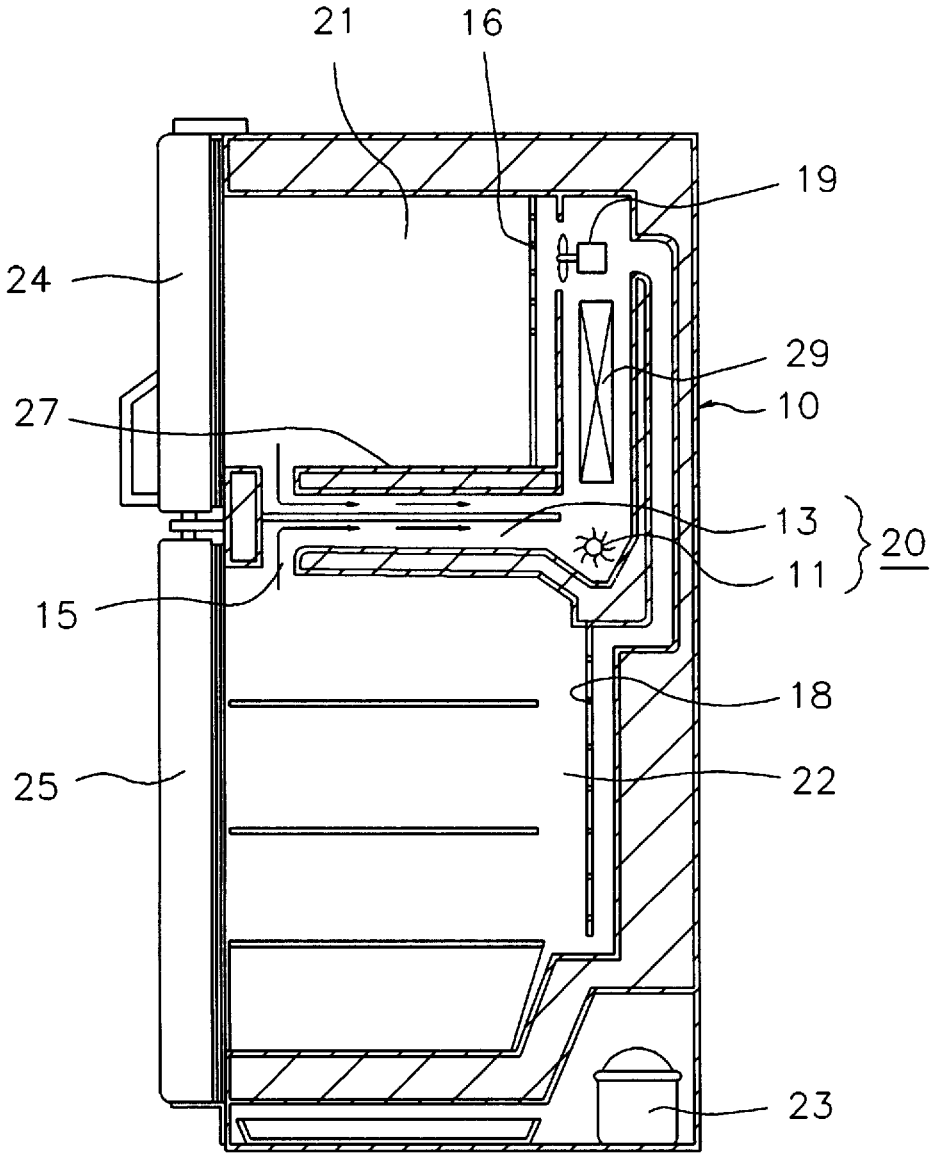
FIG. 1 PRIOR ART
FIG. 1 is a side sectional view of a conventional refrigerator having an air curtain generating device.
Figure 2:
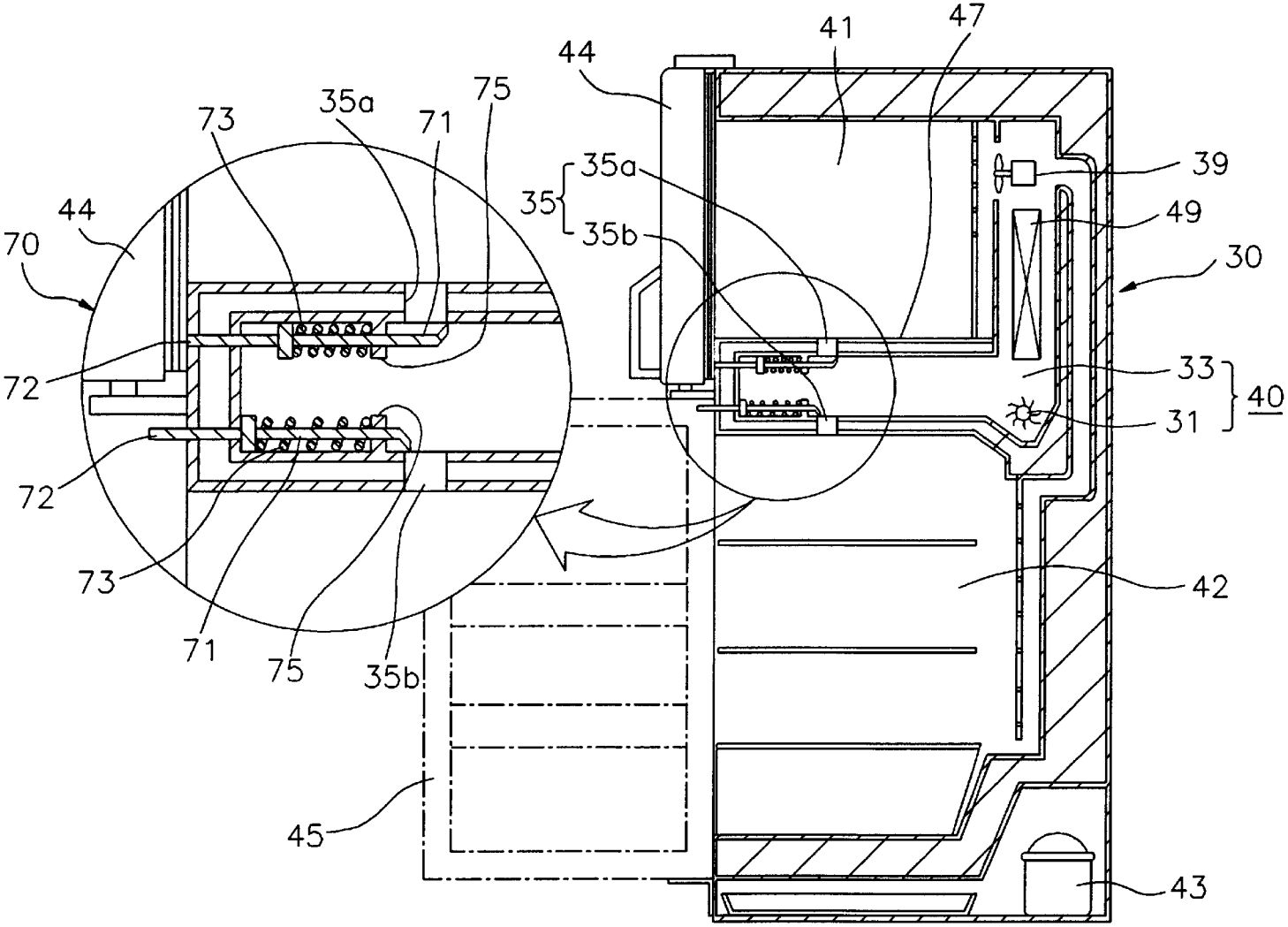
FIG. 2 is a side sectional view of a refrigerator according to an embodiment of the present invention.

FIG. 2 is a side sectional view of a refrigerator according to an embodiment of the present invention. The refrigerator according to the present invention has, as the conventional refrigerator shown in FIG. 1, a cabinet 30 forming a freezing compartment 41 and a fresh food compartment 42 which are partitioned from each other by a wall 47, and a freezing compartment door 44 and a fresh food compartment door 45 which open/close the freezing compartment 41 and fresh food compartment 42 respectively.

A compressor 43 is installed in a lower rear part of the cabinet 30, and an evaporator 49 for generating cool air by evaporating refrigerant supplied from the compressor 43 is installed in the rear of the freezing compartment 41. At the upper side of the evaporator 49, a cooling fan 39 for blowing the cool air generated by the evaporator 49 is installed to supply the freezing compartment 41 and the fresh food compartment 42 with the cool air.

A device 40 for generating air curtains is provided in the wall 47. The air curtain generating device 40 comprises a cool air duct 33 provided in the upper side of the fresh food compartment 42 and a blowing fan 31 for blowing the cool air from the evaporator 49 into the cool air duct 33. The cool air duct 33 is formed with cool air discharge ports 35*a*, 35*b* at one end thereof which are opened upward and downward at an area adjacent to the openings of the freezing compartment 41 and fresh food compartment 42 respectively. The cool air blown into the cool air duct 33 is discharged upward and downward, by which the air curtains for shutting off the openings of the freezing compartment 41 and fresh food compartment 42 are generated. A cross flow fan which is capable of blowing uniformly is adopted for the blowing fan 31.

At an area adjacent to the cool air discharge ports 35 in the wall 47, a device 70 for opening/closing the ports 35 is provided. The opening/closing device 70 comprises plates 71 for opening/closing the ports 35*a*, 35*b* respectively, push button switches 72 mounted on the cabinet 30 for being pushed and released by the doors 44, 45 when the doors 44, 45 are opened and closed respectively, and spring members 73 for elastically supporting the push button switches 72 respectively. The spring members 73 are supported by brackets 75 formed in the cool air duct 33.

When the push button switches 72 are pushed, the ports 35*a*, 35*b* are closed by the corresponding plates 71 respectively. Therefore, the air curtains are not generated when the doors 44, 45 are closed. When the push button switches 72 are released, the push button switches 72 are moved by the elastic force of the corresponding spring members 73, and thus the plates 71 open the corresponding ports 35*a*, 35*b* thereto respectively. Therefore, the upper plate opens the upper port 35*a* by which an air curtain for shutting off the opening of the freezing compartment 41 is generated when the freezing compartment door 44 is opened, and the lower plate opens the lower port 35*b* by which an air curtain for shutting off the opening of the fresh food compartment 42 is generated when the fresh food compartment door 45 is opened. When both the doors 44, 45 are opened, both plates 71 open both ports 35*a*, 35*b*, and then the air curtains are generated at both the freezing compartment 41 and the fresh food compartment 42.

Figure 3:
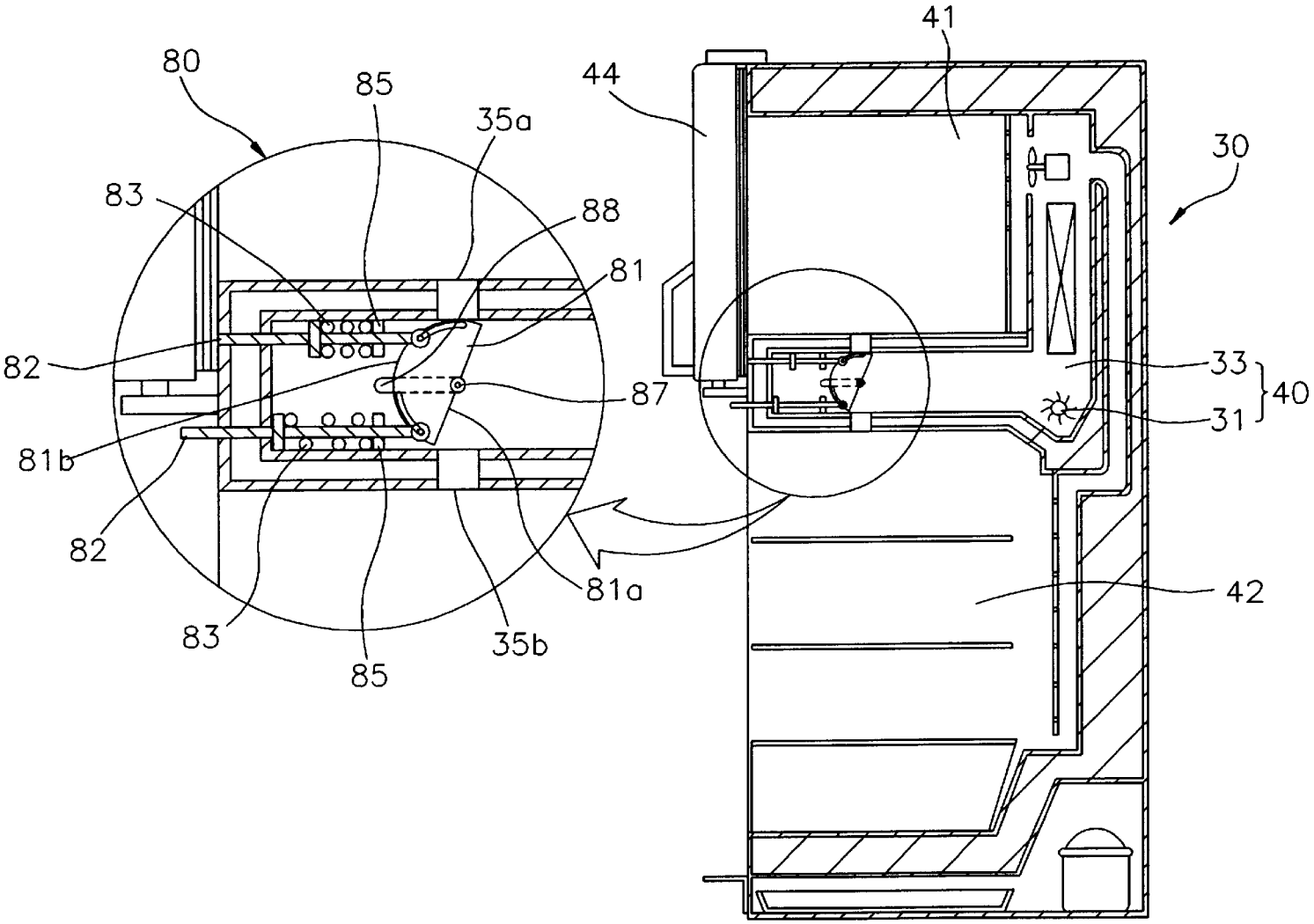
FIG. 3 is a side sectional view of a refrigerator according to another embodiment of the present invention.

FIG. 3 is a side sectional view of a refrigerator according to another embodiment of the present invention. In this embodiment, the refrigerator has, like the embodiment shown in FIG. 2, a cool air duct 33 being formed with a pair of cool air discharge ports 35*a*, 35*b*, and an air curtain generating device 40 having a blowing fan 31 installed in the cool air duct 33.

In this embodiment, the port opening/closing device 80 comprises a opening/closing member 81 being rotatably mounted in the cool air duct 33 for opening/closing the ports 35*a*, 35*b* according to the rotated position thereof, push button switches 82 mounted on the cabinet 30 for being pushed and released by the doors 44, 45 when the doors 44, 45 are opened and closed respectively, and spring members 83 for elastically supporting the push button switches 82 respectively. The spring members 83 are supported by brackets 85 formed in the cool air duct 33 respectively.

The opening/closing member is semicircular shaped in its cross sectional view, in which one side surface facing the blowing fan 31 is a plain surface 81*a*, and the back surface of the plain surface 81*a* is a semicircular surface 81*b*. The opening/closing member 81 has a shaft 87 at the center thereof, and it is rotatable while being centered by the shaft 87. In the cool air duct 33, a groove 88 is formed along the horizontal direction at a predetermined length, and the shaft 87 is accommodated in the groove 88. Thus, the opening/closing member 81 is movable along the longitudinal direction of the cool air duct 33.

One end of each push button switch 82 protrudes at the front side of the cabinet 30, and the other end thereof is linked with the semicircular surface 81*b* of the opening/closing member 81. When both doors 44, 45 are closed, the opening/closing member 81 is moved toward the blowing fan 31 by the push button switches 82, so both ports 35*a*, 35*b* are closed. Accordingly, the air curtains are not generated when the doors 44, 45 are closed. When the fresh food compartment door 45 is opened, the lower push button switch protrudes outside the cabinet 30 by the elastic force of the lower spring member 83, so the opening/closing member 81 opens the port 35*b* corresponding to the fresh food compartment 45, as shown in FIG. 3. Thus, the air curtain for shutting off the opening of the fresh food compartment 43 is formed when the fresh food compartment door 45 is opened. When the freezing compartment door 44 is opened the air curtain for shutting off the opening of the freezing compartment is formed by a similar operation. When both doors 44, 45 are opened, both push button switches 82 protrude to the front side of the cabinet 30, so the opening/closing member 81 moves away to be distanced from the blowing fan 31 along the groove 88. Thus both ports 35*a*, 35*b* are opened, and the air curtains are generated at both the freezing compartment 41 and the fresh food compartment 42.

The plain surface 81*a* of the opening/closing member 81 functions as a guide surface for guiding the cool air in the cool air duct toward the ports 35*a*, 35*b* when the ports 35*a*, 35*b* are opened respectively. That is, in the opened state of the fresh food compartment door 45, as the opening/closing member 81 rotates, the plain surface 81*a* is tilted to the left-downward direction as shown in FIG. 3, and the cool air blown by the blowing fan 31 is naturally guided toward the lower port 35*b* along the plain surface 81*a*. Therefore, the cool air is discharged through the port 35*b* without any interference due to the conversion of the direction, and the leakage of the cool air is prevented more efficiently.

As described above according to the present invention, the refrigerator in which the air curtains are formed at the opened cooling compartments so leakage of the cool air is effectively prevented is provided.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cabinet forming cooling compartments which are partitioned from each other, and doors mounted on said cooling compartments for opening/closing openings of said cooling compartments respectively, said refrigerator comprising:

a cool air duct having ports opened at areas adjacent to the openings of said cooling compartments respectively;

a blowing fan for discharging air in said cool air duct, by which air curtains for shutting off the openings of said cooling compartments are generated; and a means for opening/closing the ports corresponding to open doors when said doors are opened, the opening/closing means comprising plates for opening/closing the ports respectively and a means for driving said plates so that the ports are opened and closed corresponding to opening and closing of said doors respectively.

2. The refrigerator as claimed in claim 1, wherein said plate driving means comprises, push button switches mounted on said cabinet for being pushed and released by the doors when said doors are opened and closed respectively, by which said plates are moved so that the ports are closed and opened when pushed and released respectively; and spring members for elastically supporting said push button switches respectively.

3. The refrigerator as claimed in claim 1, wherein said cooling compartments consist of a freezing compartment and a fresh food compartment, and the ports consist of a pair which correspond to said freezing compartment and said fresh food compartment respectively.

4. A The refrigerator as claimed in claim 3, wherein said opening/closing means comprises:

an opening/closing member being rotatably installed in said cool air duct for opening/closing the ports according to the rotated position thereof; and a means for driving said opening/closing member so that the ports are opened/closed in correspondence to the opening/closing of said doors respectively.

5. The refrigerator as claimed in claim 4, wherein said means for driving said opening/closing member comprises, a pair of push button switches mounted on said cabinet for being pushed and released by the doors when said doors are opened and closed respectively, said push button switches respectively pushing said opening/closing member eccentrically in pushed state thereof; and a pair of spring members for elastically supporting said push button switches respectively.

6. The refrigerator as claimed in claim 4, wherein said opening/closing member has a guide surface for guiding the air blown by said blowing fan toward an opened port.

* * * * *